United States Patent [19]

Greenberg et al.

[11] Patent Number: 4,918,425

[45] Date of Patent: Apr. 17, 1990

[54] MONITORING AND LOCATING SYSTEM FOR AN OBJECT ATTACHED TO A TRANSPONDER MONITORED BY A BASE STATION HAVING AN ASSOCIATED ID CODE

[75] Inventors: M. Barry Greenberg, North Miami Beach, Fla.; Daniel E. Ely, 7360 Grand Ave., Winter Park, Fla. 32792

[73] Assignee: Daniel E. Ely, Winter Park, Fla.

[21] Appl. No.: 223,954

[22] Filed: Jul. 25, 1988

[51] Int. Cl.[4] ..... G08B 21/00

[52] U.S. Cl. ..... 340/539; 340/309.15; 340/572; 340/573

[58] Field of Search ..... 340/572, 573, 539, 309.15

[56] References Cited

U.S. PATENT DOCUMENTS

| | | | |
|---|---|---|---|
| 4,023,138 | 5/1977 | Ballin | 340/539 |
| 4,549,169 | 10/1985 | Moura et al. | 340/573 |
| 4,593,273 | 6/1986 | Narcisse | 340/572 |
| 4,598,272 | 7/1986 | Cox | 340/573 |
| 4,656,463 | 4/1987 | Anders et al. | 340/541 |
| 4,777,478 | 10/1988 | Hirsch et al. | 340/539 |
| 4,792,796 | 12/1988 | Bradshaw et al. | 340/573 |
| 4,814,751 | 3/1989 | Hawkins et al. | 340/572 |

*Primary Examiner*—Glen R. Swann, III
*Attorney, Agent, or Firm*—Erwin M. Barnett

[57] ABSTRACT

A radio system and method for monitoring and locating objects, including individuals, animals and articles, both locally and on a nationwide scale use monitoring base stations communicating by ID code with portable transponders which are secured to the objects to be monitored. The transponder responds to signals transmitted by the base, the latter indicating by an alarm the absence of a timely appropriate response from the transponder. The base is capable of performing and participating in homing techniques to locate a lost transponder. A list of the IDs of all transponders reported missing is distributed from a central source by nationwide communication to a network of radio stations, each station broadcasting the list in an encoded signal in repetitive sequence along with regular programming. Cruising vehicles of public safety departments operating locally nationwide are equipped with automatic monitors for receiving specially coded messages including IDs from transponders within their areas. Each transponder, after failing to receive a signal from its base for a predetermined time period has the capability of scanning the band of the radio station network, locking onto the local station of the network and receiving its ID from the locked-on station when reported lost. Upon receipt of its ID from the locked-on station, the transponder initiates transmission of the specially coded message to make its presence known to the monitor of a local cruising vehicle and thereafter is capable of establishing communication with a local base for participation in local homing.

21 Claims, 7 Drawing Sheets

MONITORING AND LOCATING SYSTEM FOR AN OBJECT ATTACHED TO A TRANSPONDER MONITORED BY A BASE STATION HAVING AN ASSOCIATED ID CODE

BACKGROUND OF THE INVENTION

1. Field of the Invention

This invention relates generally to radio systems for monitoring the whereabouts of objects including individuals, animals and articles and more particularly is directed to a system which includes a transponder attached to the object being monitored and a monitoring base station which responds to a loss of communication with the transponder, the system being capable of finding the transponder locally by homing and utilizing networks of commercial radio stations and public safety radio systems to localize the position of a missing transponder on a nationwide basis to within an area sized for finding by local homing techniques.

2. Description of the Prior Art

The problem of monitoring the removal of persons and articles from prescribed areas has been addressed and solved by various systems and radio devices.

U.S. Pat. No. 4,023,138 to Ballin discloses a vehicle theft prevention system in which a receiver on the vehicle receives a signal from a remote transmitter and detects a drop in signal strength caused by an increase in the distance between the vehicle and the transmitter and actuates an alarm on the vehicle or disables the latter.

U.S. Pat. No. 4,593,273 to Narcisse discloses an out-of-range monitor and alarm system for supervised persons which includes a base unit transmitting a signal to a mobile unit carried by the person being supervised. The mobile unit responds to a threshold circuit which is adjustable to a prescribed distance between the base and supervised person. When the distance is exceeded as indicated by a drop in signal strength, a transmitter in the mobile unit signals the base to indicate the straying of the supervised person beyond acceptable limits. The mobile unit may also sound an alarm to alert the supervised person that he is straying beyond the prescribed area.

U.S. Pat. No. 4,598,272 to Cox discloses a child monitoring device comprising two portable units, each having a radio transceiver and antenna. One of the units is secured to the child's person the other is carried by the parent. The child's unit transmits a reference signal and can receive a different, locator signal and has an audible alarm speaker which can be actuated by the locator signal. The parent's unit receives the reference signal from the child's transmitter and, by threshold detection, sounds a beep when the child's location exceeds a predetermined distance. A light signal in the parent's unit remains lit as an indication that the child's unit is transmitting and that the threshold conditions have not been met. When the beep in the parent's unit indicates wandering of the child, the parent, by pressing a button, can actuate transmission of the locator signal, which is stronger than the reference signal, to sound a raucous alarm in the child's unit to indicate the whereabouts of the child. Clearly, this device is applicable only to very special situations and is intended to operate in a limited locality.

SUMMARY OF THE INVENTION

Among the objects of the invention is to satisfy a need for a practical system for monitoring and locating objects, not only locally but also on a nationwide scale. The term "objects" as used herein and in the claims is defined to include persons, particularly children and mental incompetents, animals, particularly pets, and articles of all sorts, such as, baggage, packages, equipment, vehicles, works of art and anything for which control of unauthorized removal is desired. The system shall provide a monitoring base station for communicating by ID code with portable transponders, each being secured to an object to be monitored, which transponder shall be responsive to signals transmitted by the base to enable its being found by local homing techniques and which base shall be capable of performing a homing technique. The system shall include a nationwide network of radio stations having programming distributed from a central source by satellite or other nationwide communication, which programming shall include the IDs of all transponders reported missing. The system shall also provide participation by cruising vehicles of public safety departments operating locally throughout the nation and equipped with automatic monitors for receiving specially coded messages from transponders within their areas. Each transponder, when lost, shall be capable of scanning the band of the radio station network, locking-on to the local station of the network, receiving its ID from the locked-on station when reported lost, making its presence known to the monitors of the cruising vehicles and thereafter establishing communication with a local base for participation in the local homing techniques.

For local monitoring of children by parents:

Communication between base and transponder is by way of encoded signals. One code necessary for all signals is the ID, unique for each transponder. Other codes include instructions originating at the base for action to be taken by the transponder, such as, transferring to high power and increasing the transmission time and information originating with the transponder, such as, emergency alerts and "missing status" response.

The base station, usually located with the parent, signals the transponder which is attached to the child, the signals being sent at normal predetermined time intervals and at a normal predetermined power. The transponder responds to each base signal it receives, transmitting at normal predetermined power for whatever time is required to include the satisfactory coded message sought by the base. After a satisfactory response is recognized, the base station initiates the next transmission cycle after the predetermined time interval. A visual or audible indicator may be provided at the base signifying the timely receipt of the transponder response and thereby keeping the parents informed of the child's well being. When the base station fails to receive a timely response, audible and visual alarms are activated alerting the parent to the loss of contact with the transponder. The parent may then take appropriate steps to find the child. Also, an unsatisfactory response will trigger the base to increase transmission power for the next cycle and to encode a signal directing the transponder to also increase its transmission power. These power increases, by enhancing communication between base and transponder, seek to maintain contact with a transponder in a fringe area and enable the base, either by its homing capability, or with the aid of direction finding equipment, to find a lost transponder. The homing capability of the base includes a meter showing incoming signal strength and manual means for including in the base signal, coded instructions for the transponder to increase its transmission time to facilitate the meter reading. Manual means for overriding the normal time intervals between transmissions and permitting periods of continuous transmission by the transponder is also provided to aid in meter reading while homing.

The forced mode is the exception to the transponder transmitting only in response to a received signal having the proper ID. Forced mode signaling may be initiated at the transponder to alert the base station of special occurrences, such as removal of the transponder from the child or to alert the parent when the child perceives that he is in danger. The transponder may have a panic button to be pressed by the child or voice recognition may be utilized. The child is taught a key word or phrase which the transponder is programmed to recognize and respond to by forced mode transmission. The base will be alerted and appropriate action taken.

For locating missing children nationally:

The contemplated system is composed of its widely dispersed members, namely, parents and their children equipped with bases and transponders each having a unique ID and capabilities for operating both locally and nationally, a network of distributed stations, such as FM stations, and vehicles of local public safety agencies, such as police departments. Each of the vehicles is equipped with a monitor having a receiver permanently tuned to the transponder transmitting frequency, a visual display and an audible alarm. The network maintains a computerized updated list of IDs of missing children which is fed, in the system's coded format recognizable by the transponders, into the network's programming for broadcasting by each network affiliate in a continuous repetitious sequence. The transponder of the missing child, after losing contact with a local base, scans the band of network stations. Finding and locking on to the local network affiliate, the transponder awaits receiving its ID code among those being broadcast. The ID code when received is recognized as emanating from a network affiliate and the transponder inserts a "missing" code in its responsive transmission. This "missing" code is received by the monitor in the nearest local vehicle which automatically displays the ID of the lost transponder while sounding an alarm. Appropriate homing or triangulation operations may now be conducted on the base frequency by local bases transmitting the ID of the lost transponder newly discovered by the vehicular monitor. To make this possible, both during scanning and after lock-on to the local affiliate station, while waiting for a "missing" code, the transponder returns to the base frequency at predetermined intervals for possible contact with a base transmitting its ID. When its ID is detected, the transponder remains tuned to the base frequency and responds to the base transmissions enabling the homing to proceed and be successful.

DESCRIPTION OF THE PREFERRED EMBODIMENT

Figure 2:
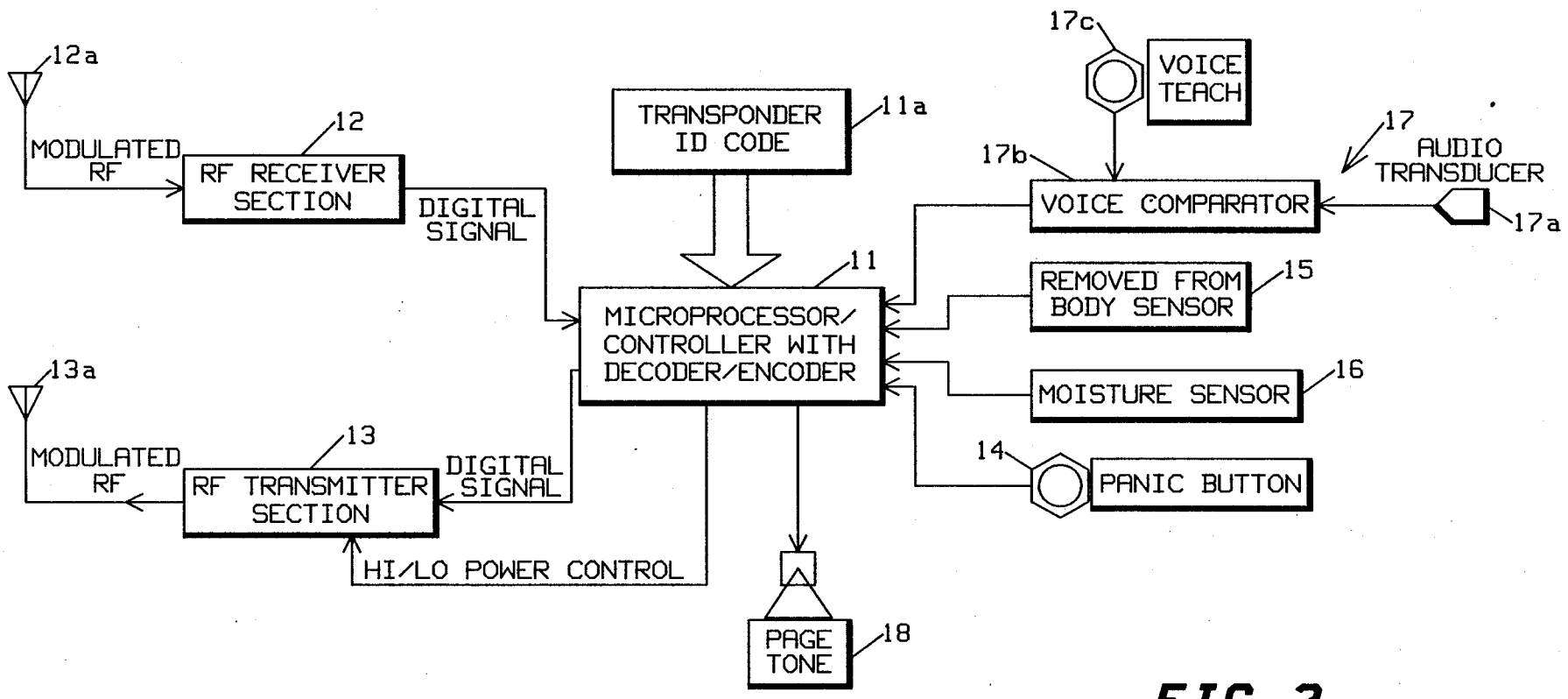
FIG. 2 is a block diagram of the components in the transponder.

Referring to the drawings, 10 is a transponder comprising miniaturized components shown in the block diagram in FIG. 2 and a power supply therefor, provided as a battery (not shown). Transponder 10 generally comprises a controller, herein being in the form of microprocessor 11, an RF receiver 12 and its antenna 12*a*, a transmitter 13 and its antenna 13*a*. Microprocessor 11 may also have input from an ID code selecting means 11*a* which may be a series of DIP switches and several alarm condition detectors, namely, a panic button 14, a removal detector 15, a moisture detector 16 and a voice code detector 17, the function and operation of which is hereinafter described. Detector 17 includes audio transducer 17*a*, voice comparator 17*b* and a voice reference button 17*c*. As an optional component, microprocessor 11 may also have an output to a tone transducer 18.

Figure 3:
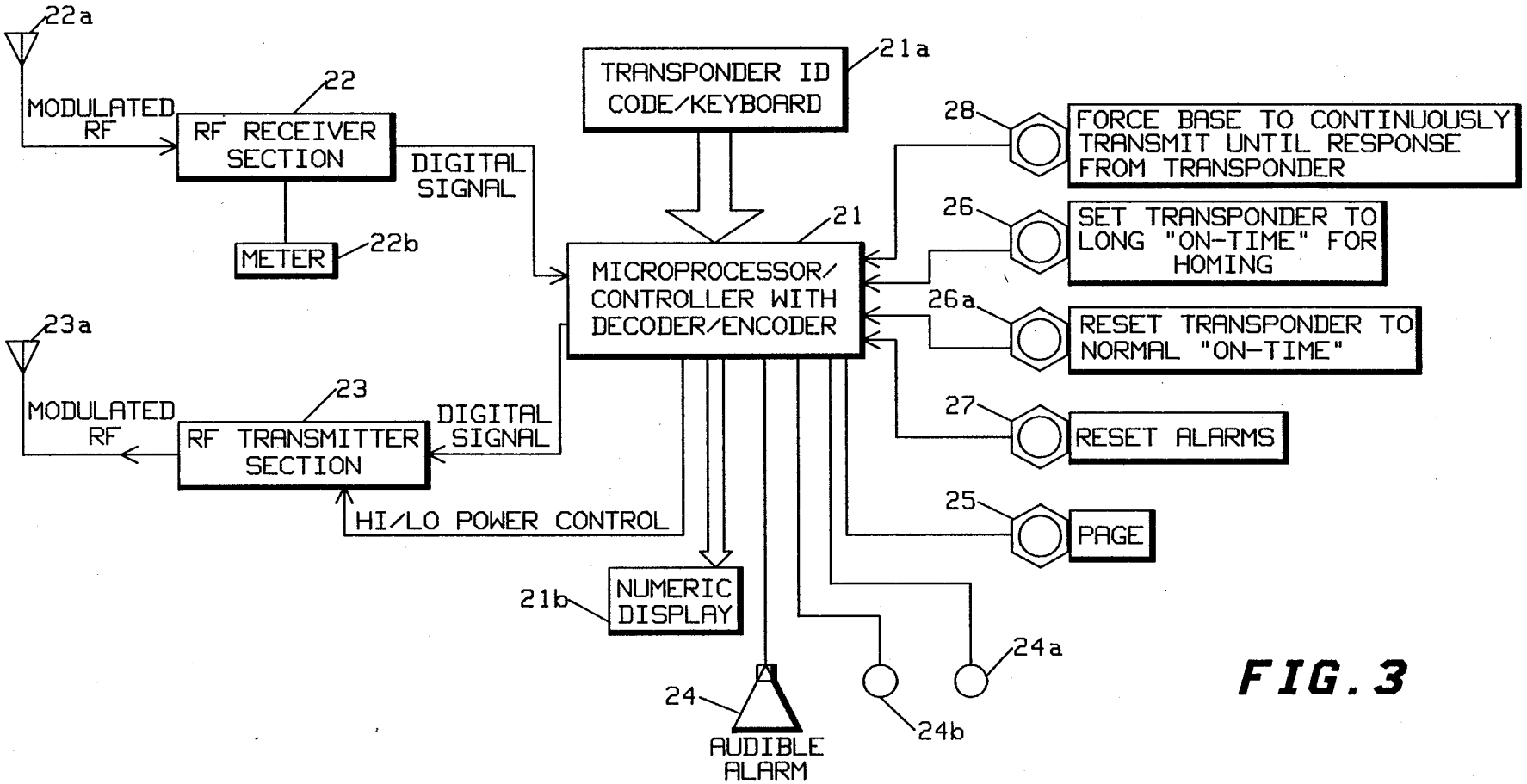
FIG. 3 is a block diagram of the components in the transceiver located at the base station.

The block diagram in FIG. 3 shows the base station transceiver 20 as comprising a controller, also in the form of microprocessor 21, an RF receiver 22, its antenna 22*a* and a meter 22*b* to indicate the relative strength of the incoming signal, a transmitter 23 and its antenna 23*a*. Manual inputs to microprocessor 21 for composing the content and other characteristics of the signals to be sent by transmitter 23 are shown to include an ID code selecting means 21*a*, page button 25, "long time" button 26, "normal time" button 26*a*, reset alarms button 27 and continuous transmission button 28. Selecting means 21*a* may utilize DIP switches, thumbwheel switches, a keyboard or other suitable means to enter the ID of each transponder to be monitored. Outputs from microprocessor 21 may include audible and visual alarm indicators 24 and 24*a*, a transponder response indicator light 24*b* and numeric or alphanumeric display 21*b*. Transceiver 20 also has a power supply (not shown), which may be batteries and/or a suitable connection to other electric power.

The following timers and counters, being integral with microprocessor 11 or 21 and therefore not shown in the drawings, have letter and numeral designations for clarity in the text and flow charts. Thus, microprocessor 11 includes timers T11, T12 and T13 and a counter C11 and microprocessor 21 includes timers T21 and T22. Each letter and numeral is also used to designate the timer interval, per se, measured by the respective timer. Timers T11, T12, T13, and T21 are free running and will stop and remain at their respective predetermined elapsed times until reset.

The system will first be described for a base station 20 monitoring a single transponder 10 which has been initialized by entering a unique digital ID code using ID code selecting means 11*a*. Microprocessor 21 at base station 20 is also initialized using ID code selecting means 21*a* to transmit the ID code to which transponder 10 will respond, the code selection being shown on numeric display 21*b*. Transceiver 20 transmits an encoded signal at a predetermined frequency BF in periodic cycles separated by a predetermined time interval T22. Interval T22 is 1 or 2 minutes and is chosen as a compromise between the desirability of having frequent contacts by the base with the transponder and the necessity for conserving power consumed by each response by the transponder which relies on a relatively small battery for its power. The digital signal is in a prescribed format recognizable by all units of the system and in addition to the ID code, the format provides for the inclusion of other codes required for directing and controlling the operation of transponder 10, for example, a power code, a time code, a page code, and others, and for the transponder's informing the base of sensor activation and the like, the purpose and function of which and manner of entry are hereinafter described.

Figure 5:
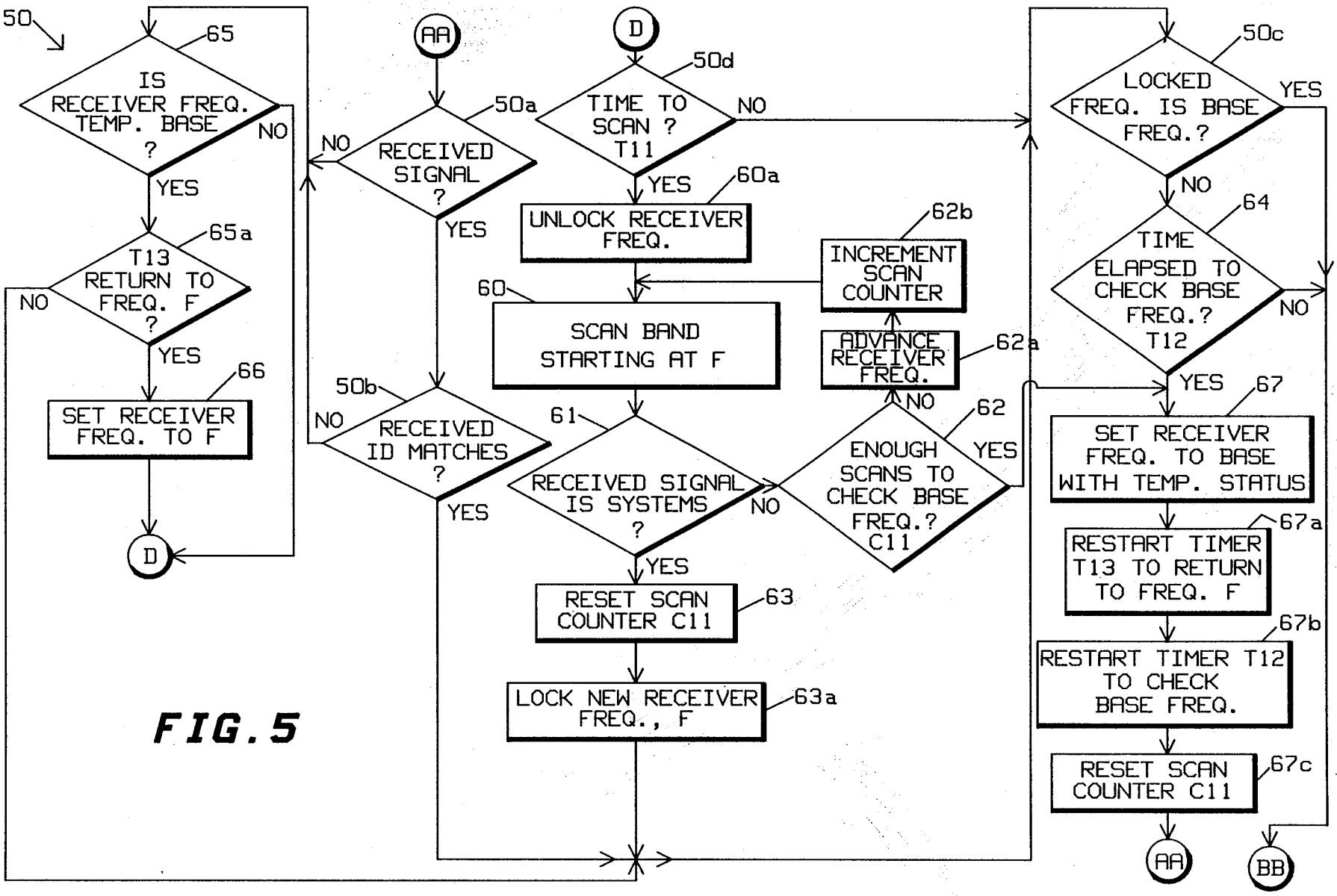
FIG. 5 is a flow chart of the logic performed within the first task block 50 of the transponder flow chart shown in FIG. 4.
Figure 6:
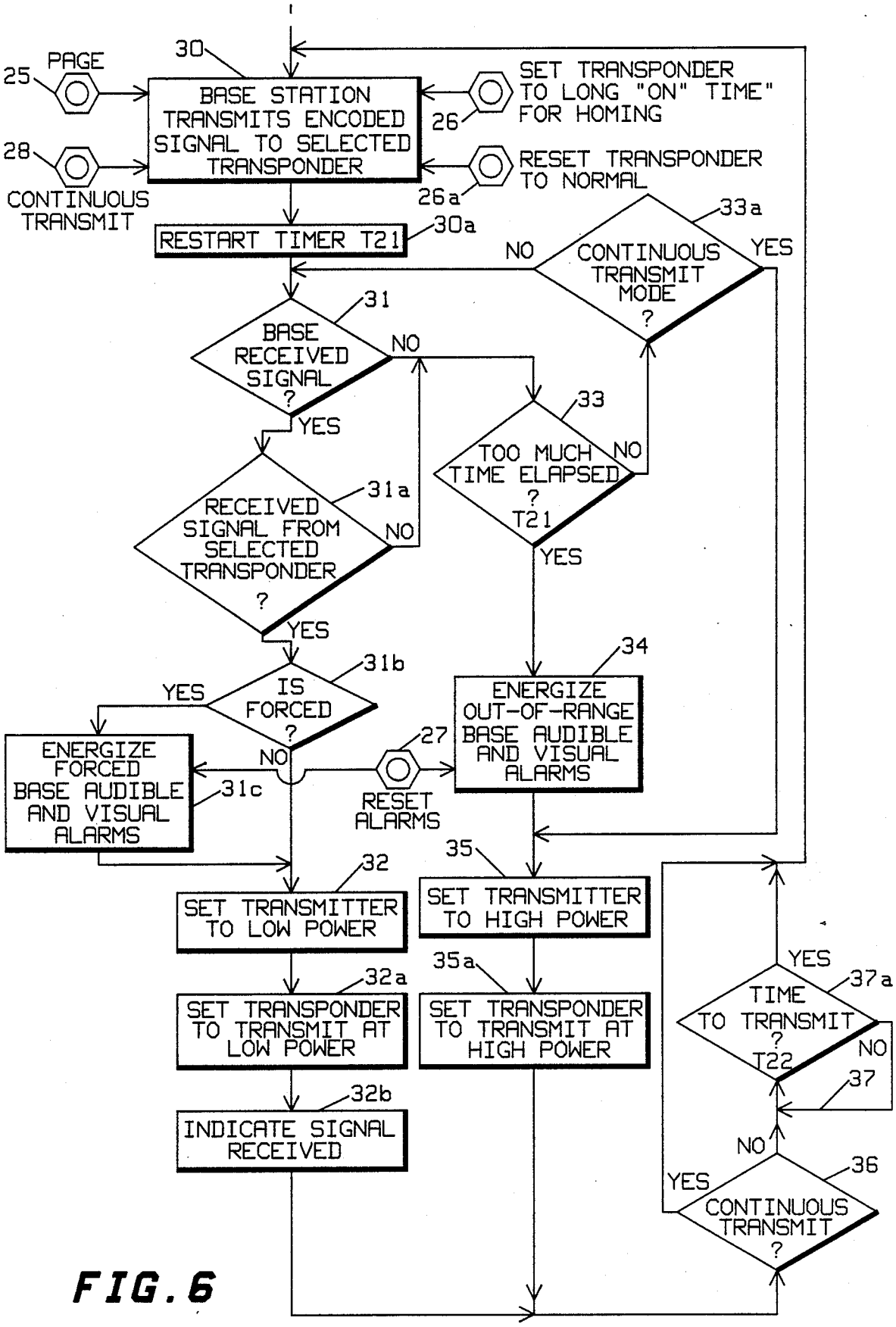
FIG. 6 is a flow chart showing the logic performed by the base station.

When base 20 and transponder 10 are in normal communication, transmitter 23 sends the encoded signal as indicated in task 30 shown in FIG. 6. Initially the only code required for a transponder response or action may be the ID code. Microprocessor 11, controlling the operation of transponder 10 has initially tuned receiver 12 (task I in FIG. 4) to the default frequency which is the transmitting frequency BF of base 20. Task 50, shown in FIG. 4, comprises the subroutine shown in FIG. 5, which enables transponder 10 to maintain normal communication with base 20 at the latter's frequency BF but to take action when transmission from base 20 is lost and is not reestablished after a predetermined time lapse, hereinafter designated time T11 which is measured by timer T11. Time T11 is herein arbitrarily chosen at 1 hour to allow sufficient time for re-establishing communication with base 20 or to undertake and complete homing operations by base 20 or other local equipment and to arrange for broadcasting the ID by the nationwide system, as hereinafter described. This accomplishes a dual purpose: (1) Transponder 10 will remain tuned to the base frequency BF for the hour T11 after losing contact and then will be transferred to the nationwide aspect of the system whereby receiver 12 is switched to a mode for scanning, such as the FM band of commercial radio stations, and (2) transponder receiver 12 will be periodically returned to the base frequency BF for possible contact with base 20, the latter being any base within the system seeking contact with transponder 10 by using the appropriate ID code.

Figure 4:
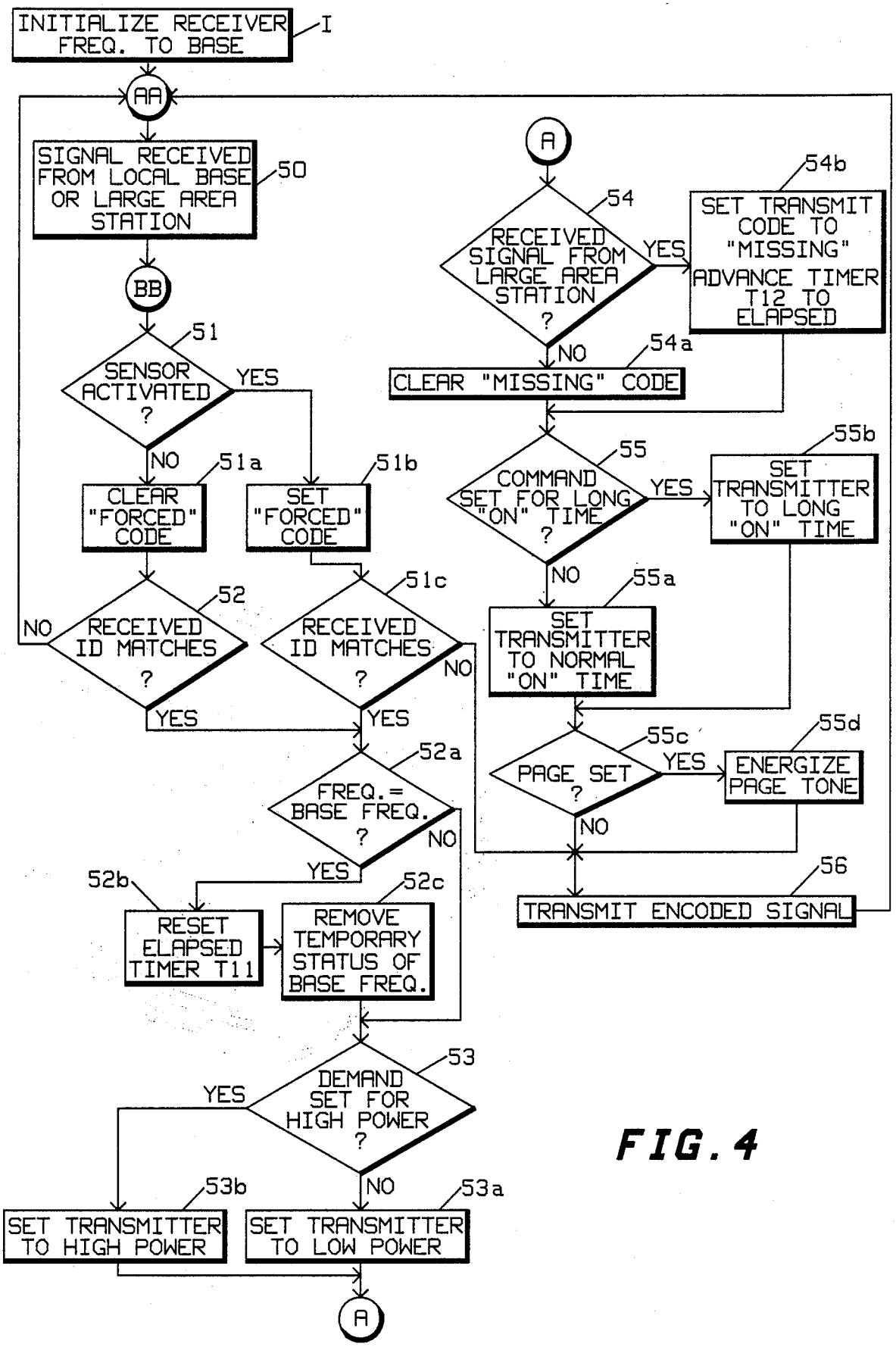
FIG. 4 is a flow chart showing the logic performed by the transponder.

Assuming transponder 10 has received the transmitted signal, as seen in FIG. 5, task 50 proceeds through tests 50*a*, 50*b* and 50*c*, all of which being "yes", continues at BB in FIG. 4 where test 51 checks for sensor activity, finding none and clearing the "forced" code by task 51*a*, finds an ID match at test 52 and finds the frequency setting at test 52*a* to be at base frequency BF. Then task 52*b* resets free running timer T11 and task 52*c*, which removes temporary status of base frequency, has no significance here, since the base frequency is in a permanent status. Test 53 for high power demand being negative, task 53*a* then sets transmitter 13 to low power. Test 54, ascertaining that receiver 12 has been set to the base frequency BF by determining whether the received signal is from the local base or from the large area network, clears the "missing" code by task 54*a*. Testing at 55 for long "on" transmission time, transmitter 13 at task 55*a* is accordingly set to normal "on" time which is typically a fraction of a second in duration. Finding no paging instruction at test 55*c*, task 56 then transmits the response at normal "on" time under low power and without a "missing" code.

FIG. 6 shows the base station 20, after transmitting and restarting response timer T21 by tasks 30 and 30*a*, checking at test 31 for a response from transponder 10. The response time T21, which is predetermined and set at about ½ second, provides sufficient time for the base to transmit, for transponder to receive and process the signal and in turn transmit the response and for the base to receive the signal. Inasmuch as, immediately after transmission, sufficient time will not have elapsed for a response to have been received, test 31 branches to a time delay loop comprising test 33 for checking timer T21 and test 33*a* which checks for the continuous transmit instruction, the function of which is later described and which is in effect only while button 28 is depressed. Return to response received test 31 completes the time delay loop. Normally before T21 expires, the response from transponder 10 is received, test 31 is positive and branches to test 31*a*, which verifies the transponder ID. If found to be negative, re-entry to the time delay loop is made, otherwise test 31*b* determines whether the transponder response was "forced". The latter being negative, tasks 32, 32*a* and 32*b*, respectively, sets transmitter 23 to low power, encodes a low power instruction to transponder 10 and energizes a visual signal 24*b* for a predetermined time to indicate to persons operating base 20 that the response was received and normal communication with the child wearing the transponder is in effect. This completes a normal uneventful communication cycle in which transponder 10 has responded to the monitoring transmitted signal of base 20.

Before the next communication cycle is initiated, test 36, in checking continuous transmit button 28, either bypasses the time delay loop 37 and proceeds immediately to task 30, or, normally finding button 28 not depressed, enters loop 37, which includes test 37*a* and timer T22, to provide the desired time T22 between transmissions.

In the event that base 20 fails to receive the appropriate signal from transponder 10 after time interval T21 has elapsed, test 33 branches to initiate the base alert procedure by task 34 energizing the base audible and/or visual alarms 24, 24*a*. Tasks 35 and 35*a* then set transmitter 23 to transmit at high power and to encode the next signal to also set transponder 10 to high power. Thus, the next transmission by base 20 when no timely response was received occurs after time interval T22 (1 or 2 minutes) at high power and will include the power code instruction for transponder 10.

The person monitoring base 20, having been alerted that communication with the transponder has been lost, will reset alarms 24, 24*a* by pressing button 27 and then proceed to locate the child in accordance with suggested procedures hereinafter described.

While waiting for the next signal from base 20, the transponder program in FIG. 5, showing a "no" response to test 50*a*, branches to test 65 for a "no" to receiver 12, being temporarily tuned to base frequency BF and then by way of D to test 50*d* where timer T11 is checked to determine whether sufficient time has elapsed from reception of the last valid signal from base 20 to transfer transponder 10 to the nationwide operation, which is hereinafter described. At this point test 50*d* is "no", continuing the program to BB by way of test 50*c*. To summarize the transponder waiting loop during the time interval T21 between transmissions by base 20, the encoded response having been transmitted by task 56, the program returns to AA, commences task 50 by test 50*a*, branches to test 65, either directly or by way of 50*b*, which would be the case where other bases in the area are transmitting with IDs for their particular transponders. The loop continues by way of D to test 50*d*, then to test 50*c*, shown in FIG. 5, and returns to BB in FIG. 4. Sensor activation at test 51 being "no", "forced" code is cleared at 51*c*, test 52, finding no ID match, returns to AA and again commences task 50.

Since a likely cause of base 20 failing to receive a timely response is an out-of-range condition, which term is used herein to designate that condition in which the relative locations of base 20 and transponder 10 is a fringe area reached by high power transmission, switching to high power by both base and transponder may re-establish communication. However, such communication will only occur for the very next cycle because when test 31 for timely signal reception is "yes", tasks 32 and 32*a* set the transmission from base 20 to low power and instructs transponder 10 to respond at low power. This will result in alarms 24, 24*a* being repeatedly energized and indicate the presence of transponder 10 in a fringe area. At this point the homing capability of base 20 can be utilized.

When the alert received at base 20 is determined, as hereinbefore described, to be due to an out-of-range condition, in addition to other search procedure being used, base 20 may serve as a homing instrument. While moving base 20 from place to place in a homing pattern in the well understood manner, button 26 is used to set task 30 to include a code in each transmitted signal which sets transponder 10 to long-on-time transmission. The duration of long-on-time is measured in seconds compared to fractions of a second for the normal-on-time and is predetermined to be sufficient to obtain readings on meter 22*b* for homing purposes. The long-on-time code is detected by transponder 10 at test 55 and set at task 55*b* preparatory to the transmit task 56. Bearing in mind that transponder 10 responds to alternate transmissions of base 20 when in the out-of-range condition and, therefore, when T22 is 2 minutes, the responses will be 4 minutes apart, which may be too long to wait between meter 22*b* readings. Pressing continuous transmit button 28 will result in immediate transmission from base 20, an immediate response from transponder 10 and a subsequent meter 22*b* reading. As will be clear from FIG. 6, the time intervals T22 between base 20 transmissions are bypassed at test 36 when button 28 is depressed so that in operation the transmissions will appear to be continuous. Likewise, whenever test 31 or 31*a* is "no", which may result from a previous path through tasks 32 and 32*a* having set low power transmission, button 28 will cause a "yes" at test 33*a*, resulting in tasks 35 and 35*a* setting the high power transmission mode and enhancing communication with transponder 10. When the path is by way of a "yes" at test 33, the alarms also will be actuated. However, this annoyance can be avoided by depressing reset alarm button 27 during homing.

The exception to the transmission by transponder 10 being solely responsive to and initiated by incoming, properly identified, signals is the "forced" code capability whereby conditions detected by body removal sensor 15, moisture sensor 16 and calls for help by the child, namely, by panic button 14 and voice comparator 17, are immediately also detected by test 51, branching to task 51*b* which sets a "forced" code and branches directly to the transmit task 56 when no ID match is found at test 51*c*. Finding an ID match, the path rejoins the "yes" of test 52 and proceeds as an ID match which had no sensor activation, the difference being that transmit task 56 transmits a response which now includes the "forced" code. As long as test 51 for sensor activation is "yes", transponder 10 will repeatedly transmit the "forced" code whether or not the base is requiring a response.

When base 20 receives a signal identified as that of the monitored transponder 10 by test 31*a*, the following test 31*b* identifies the "forced" code and branches to task 31*c* which energizes the alarms. Although only one set of alarms 24, 24*a* are shown in FIG. 3, these may suffice inasmuch as the parents monitoring the base upon receiving any alarm will initiate a procedure to locate the child. However, it is anticipated that a more complex version of transponder and base may include the capability of the transponder sending a "forced" code encoding the particular emergency condition and the base alarms indicating such particular condition.

Figure 1:
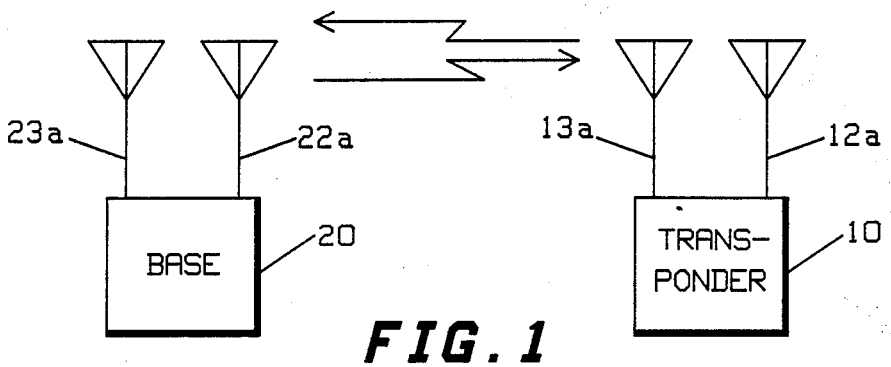
FIG. 1 is a schematic diagram of a local segment of the monitoring and locating system embodying the invention.
Figure 7:
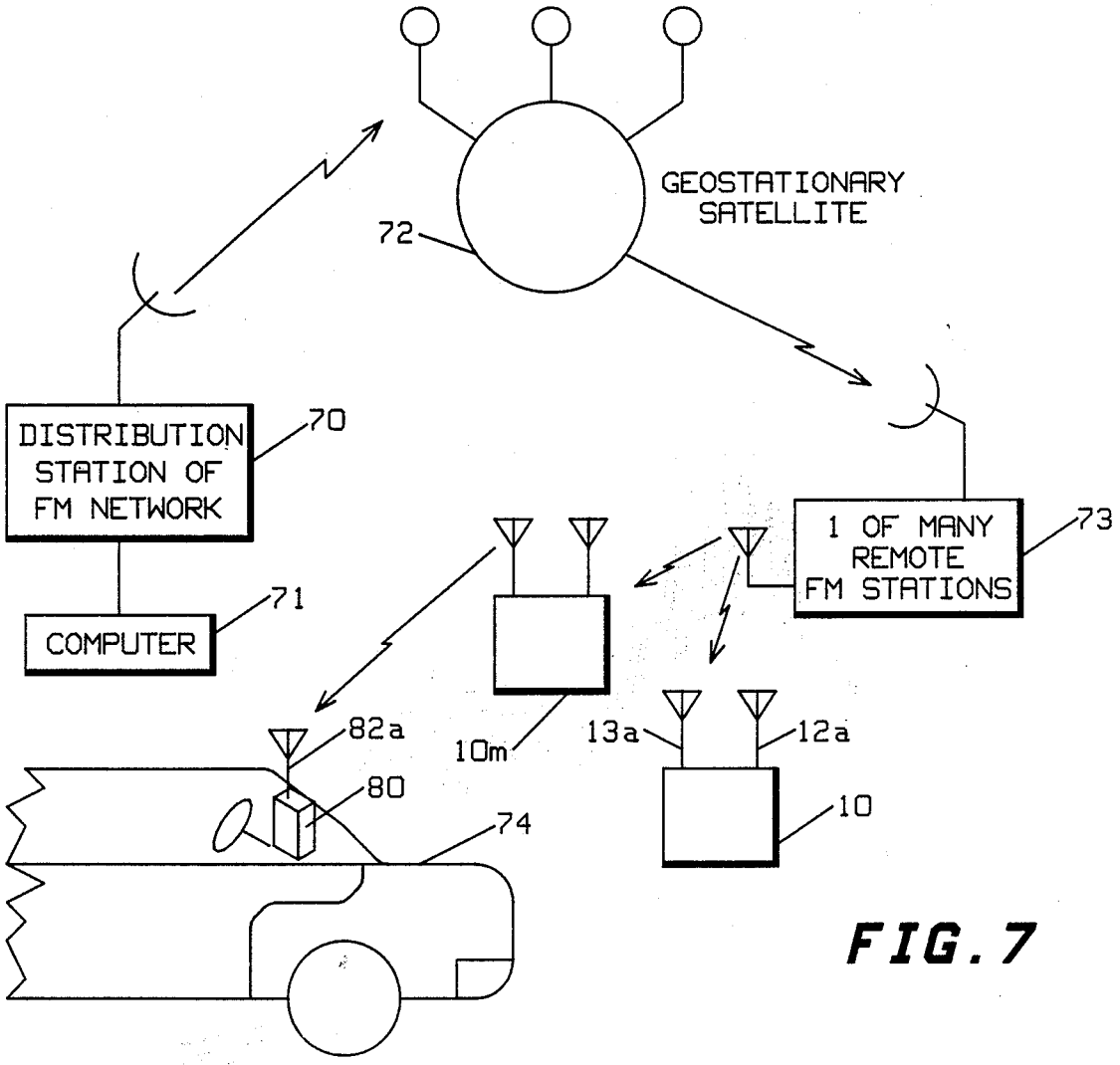
FIG. 7 is a schematic diagram of the nationwide system embodying the invention utilizing a distributive radio network.
Figure 8:
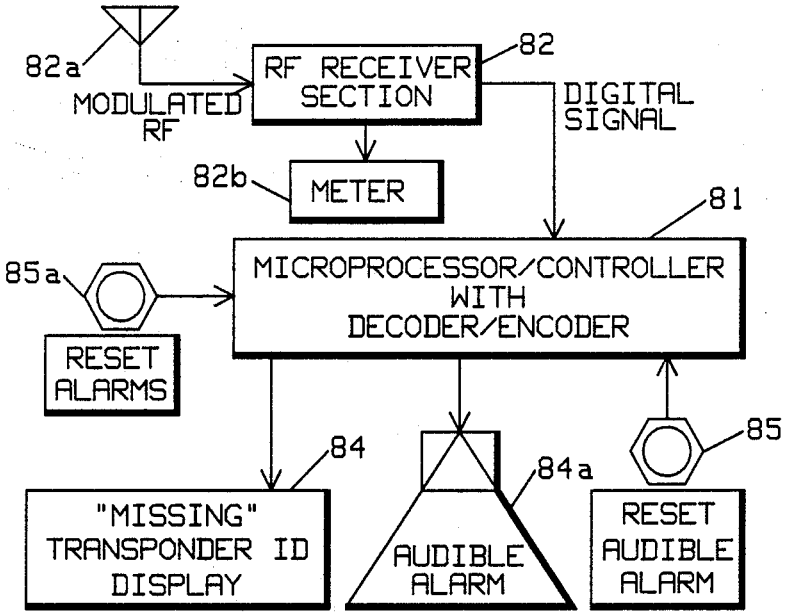
FIG. 8 is a block diagram of the components in the monitor installed in the vehicles of local public safety departments.

The components of the nationwide aspect of the child finder system are shown in FIG. 7 to comprise a network of affiliated local stations, FM stations 73 by example, which broadcast continually, 24 hours each day, and are located so that their sum total blankets the entire nation. Such networks now exist and may be currently in nationwide pager services. A computer 71 maintains a current updated list of the IDs of all transponders 10 reported missing, encodes the IDs into the prescribed format and outputs the missing codes individually and in sequence to a distribution station 70 of the FM network. The sequence of missing ID codes is sent to each local FM station 73 in the network by satellite 72, or other distribution means, for local broadcast along with regular programming and is only apparent to transponders 10 or other similar devices programmed to receive and process the encoded information of the child finder system code. The area serviced by each local FM station 73 has one or more local public safety departments, each having cruising vehicles 74 equipped with monitors 80. Each vehicular monitor 80 is permanently tuned to and continuously monitors the transponder transmit frequency common to all transponders. FIG. 8 shows monitor 80 to comprise microprocessor 81, an RF receiver 82 and its antenna 82*a* and a meter 82*b*, a display 84 for showing the "missing" transponder ID when detected in the local area, an audible alarm 84*a*, a reset button 85 for the audible alarm 84*a* and a reset button 85*a* to reset both the display 84 and alarm 84*a*. Monitor 80 is primarily powered by the battery of vehicle 84 and by a secondary internal battery in the event that the vehicle battery is disconnected (neither being shown). Other vehicles, such as helicopters of local public safety departments, may also be equipped with monitors 80.

The nationwide aspect of the system enables a lost transponder, shown in FIG. 7 as transponder 10*m*, to be detected at any remote location by the vehicular monitor 80 in that location. This is accomplished by the capability of the transponder to transfer the transponder receiver frequency from the base frequency BF to a scanning mode and to periodically return to the base frequency BF. In the scanning mode, each of the stations in the scanned band is tuned and tested sequentially and when one is found to be a part of the system, it is locked onto. This lock-on permits the monitoring of the list of IDs of "missing" transponders which is being broadcast continuously in a repetitive sequence by all the stations in the system. As long as the transponder continues to receive this station, the monitoring will continue except for periodic temporary transfers to the base frequency for possible communication with a local base. Upon receiving its ID code from the list of "missing" transponders, a response from transponder 10*m* is broadcast with a "missing" status code to be received and identified by the vehicular monitors 80. When this is accomplished, the location of this "missing" transponder will be known to be in a limited area of about ¼ mile radius. After sending the "missing" status code, the receiver is transferred temporarily to the base frequency BF and is returned thereto at predetermined time intervals, otherwise remaining tuned to the lock-on station. When the temporary base tuning results in the finding of a local base sending the ID of the "missing" transponder, usually in continuous base transmit mode, the temporary base frequency status of transponder 10 will be removed so that regular communication with the new found base can be established enabling homing procedures to be conducted.

This capability to switch to the nationwide network is seen in FIG. 5 to include test 50*d* which checks timer T11, and, when the 1 hour waiting period has been found to have elapsed, the path branches to tasks 60*a* and 60 which unlocks receiver 12 and commences to scan the band of network stations. Initially the scanning will begin at a default frequency F. Thereafter, frequency F will be the current station frequency of the scanning procedure. Upon the first entry into scanning by way of test 50*d*, counter C11 will have been initialized and thereafter counts the stations checked by test 61 and found lacking system affiliation. When test 61 is "no", test 62 checks scan counter C11 to determine whether sufficient scanning, as measured by a predetermined number, has taken place to temporarily check the base frequency BF for possibly establishing contact with a local base station. For the case of the commercial FM radio band, there being about 100 possible stations, a predetermined number for counter C11 of 110 would ensure scanning the complete FM band before an attempt to contact a base station is made.

In this illustration test 62 being "no", task 62*a* advances the receiver to the next frequency in the band and task 62*b* increments counter C11 and the search for the local station continues, the path remaining in loop 60,61,62, 62*a* and 62*b* until either test 61 finds a signal from a station belonging to the system or test 62, by checking counter C11, indicates that sufficient scanning has occurred to temporarily check the base frequency BF. When test 61 is "yes", tasks 63 and 63*a* resets scan counter C11 and locks receiver 12 onto the current station frequency F. From task 63*a* the path goes to test 50*c* which determines that receiver 12 is in fact locked onto a scanned station and then proceeds to check elapsed timer T12 at test 64. The predetermined elapsed time T12 is chosen to allow sufficient time for a scanned station to which receiver 12 is tuned to transmit at least one sequence of the entire list of missing ID codes being supplied by computer 70 of the system, time T12 being estimated in a range of 20 minutes. Likewise, timer T13 measures the predetermined time T13 for temporarily retaining receiver 12 at base frequency BF which is about 3 minutes, having been chosen as sufficient to allow for being contacted by a base 20 transmitting at a 2 minute T21 interval.

Being free running, timer T12 starts when transponder 10 begins operating and will have reached the elapsed state when test 64 is first encountered. Thus, on this transit, task 67 sets receiver 12 to base frequency BF on a temporary basis, tasks 67*a*, 67*b* and 67*c* restarts timer T13, restarts timer T12 and resets counter C11, respectively, and continues at AA. As long as tests 50*a* or 50*b* are "no", the loop, during time T13 while the receiver 12 is temporarily tuned to base frequency BF, will comprise tests 65, 65*a* and 50*c* to BB, then to test 52 and returning to test 50*a*. Encountering a "yes" at test 65*a*, task 66 sets receiver 12 to frequency F and the program branches to a loop which continues checking the locked-on station of the system for verifying the "missing" status of the transponder and then transmitting the "missing" code for detection by the local vehicular monitors 80. This loop comprises tests 50*a*, 50*b*, 65 and, by way of D, to test 50*d*, finding timer T11 exceeding the 1 hour, branches to tasks 60*a* and 60, to test 61, which confirming that the signal belongs to the system, continues to tasks 63 and 63*a*, then to tests 50*c* and 64, returning to BB and test 52 and then to begin again at 50*a*. This look may be exited in several ways, namely, (1) when an ID match is found at test 52, resulting ultimately in the desired transmission of the "missing" code by the lost transponder, (2) when test 64 is "yes" resulting in temporary transfer of receiver 12 to the base frequency BF, or (3) when test 61 being "no" indicates that contact with the local scanned station has been lost and scanning is reinstated. As an example this latter case will occur when transponder 10 is in transit and passes from one scanned station area to another. Exiting by way of test 64, (2) above, has been hereinbefore described and occurs at the time intervals measured by timer T12. Other aspects of this feature are hereinafter described.

When an ID match is found at test 52, test 52*a*, checking the frequency of receiver 12 and finding the scanned frequency F, branches to test 53 and then to task 53*a* to set the transmitter to low power and then continues to A where test 54 verifies the ID as having been broadcast by a scanned station. Thereafter branching to task 54*b* where the "missing" code is set for transmission and after task 55*a* sets transmitter for normal "on" time, task 56 transmits the encoded signal which includes the "missing" code. Task 54*b* also advances timer T12 to an elapsed state for a purpose hereinafter described.

Figure 9:
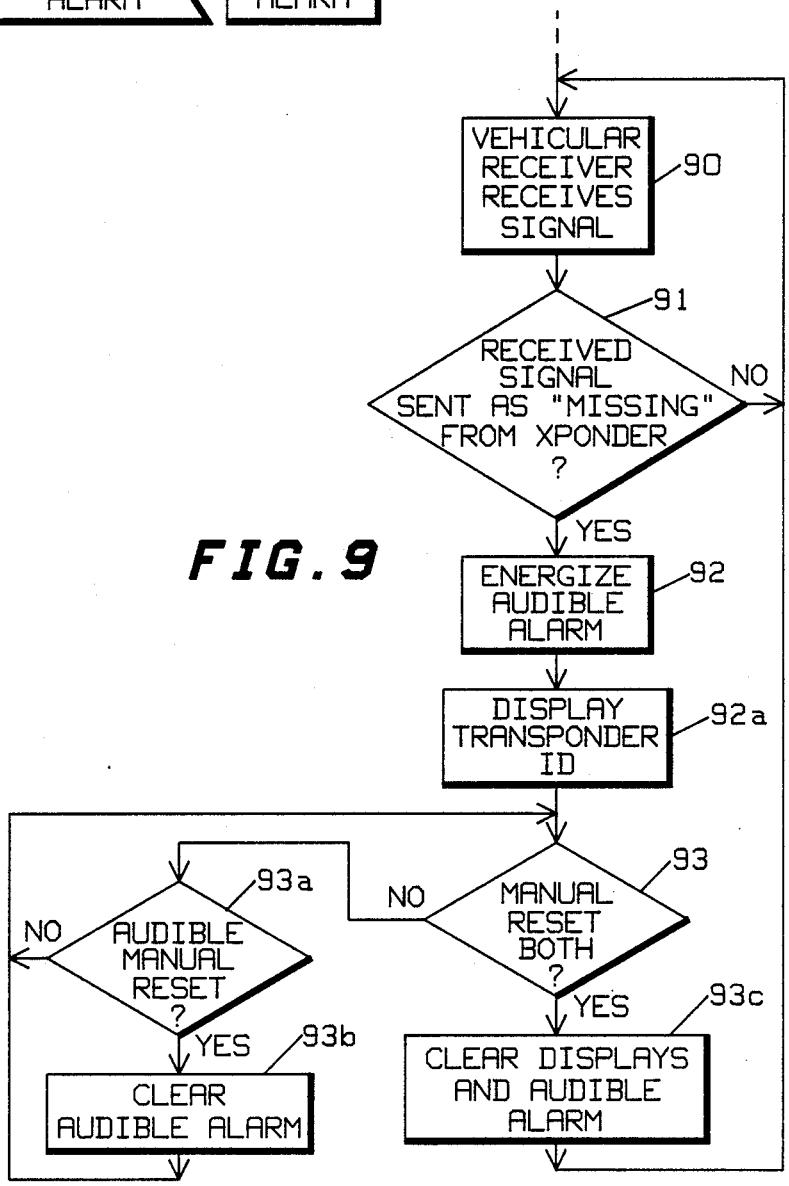
FIG. 9 is a flow chart of the logic performed by the vehicular monitor shown in FIG. 8.

A local vehicular monitor 80, receiving signal at task 90, shown in FIG. 9, and finding the "missing" code at test 91, sounds the alarm 84*a* and displays the ID of the "missing" transponder on display 84 by tasks 92 and 92*a*, respectively. By pressing reset button 85, the audible alarm 84*a* is shut off by task 93*b* arrived at through tests 93 and 93*a*, permitting the ID display to remain as long as desired while homing procedure is initiated. When button 85*a* is pressed, test 93 clears both alarm 84*a* and display 84 or only the latter if alarm 84*a* had previous been cleared by button 85*a*.

The capability of receiver 12 to periodically transfer from a locked-on scanned frequency F to the base frequency BF enables the nationwide system to ultimately communicate with a formerly lost but now localized transponder 10, making homing thereon possible. When receiver 12 is transferred from the scanned frequency F to the base frequency BF in a temporary status as a result of test 64 indicating the lapse of sufficient time T12 (about 20 minutes) for transponder 10 to have detected its ID code in the scanned broadcast and accordingly transmitted the "missing" code, several circumstances may exist, one being homing in progress by a local agency as a result of detection by a vehicular monitor 80. When the latter is the case, a base station similar to 20 will be used to transmit the lost transponder's ID along with other coded instructions. After changing to base frequency BF on a temporary basis at task 67 and performing the resetting tasks of 67*a*, 67*b* and 67*c*, the control continues at AA where initially test 50*a* may show no signal and branches to test 65, confirming that receiver 12 is tuned to base frequency BF on a temporary basis. Test 65*a* being "no" after checking timer T13, control branches to bypass test 50*d*, which would re-establish the scanning mode, and instead goes directly to test 50*c* which, being "yes" continues to BB, to a "no" test at 51, to test 52 and returning to AA. Thus, while waiting to contact a base station, the control remains in the temporary base station loop comprising test 50*a* to test 65, either directly or by way of test 50*b* which would be the route when a signal is received without this transponder ID, then to tests 65*a*, 50*c*, 51 and 52 and then back to test 50*a*.

While in this loop, any transmitting base station 20, which has been brought into the search and initialized with the ID of this transponder 10, will be detected at tests 50*a*, 50*b* and 52 thereby branching to test 52*a* and to tasks 52*b* and 52*c*. Task 52*b*, by resetting timer T11, prevents branching into the scanning mode until 1 hour of "no contact" with a base 20 has elapsed. Likewise, task 52*c*, by removing the temporary status of the base frequency BF assures a "no" at test 65 thereby preventing transfer of receiver 12 to scanned frequency F until a scanning mode is re-established by way of test 50*d* and the 1 hour time lapse of timer T11. Failure to contact a base station 20 while in this temporary base frequency loop for time T13 (about 3 minutes) results at test 65*a* in receiver 12 returning to scanned frequency F for another attempt to receive and transmit the "missing" ID code and alert a local vehicular monitor 80, as hereinbefore described.

As soon as vehicular monitor 80 "finds" a "missing" transponder 10*m*, one or more bases 20, which are available to the local authorities, may be initialized with the ID shown on monitor display 84. Thereafter, within time T12 (about 20 minutes), communication with the "missing" transponder 10*m* should be established enabling homing procedures similar to that hereinbefore described to be instituted or, with base 20 now controlling the transponder transmissions, equipment having direction finding capabilities may also be used. To reduce the effective time T12 (about 20 minutes) and enable transponder 10*m* to check the base frequency BF more often, a procedure may be adopted whereby whenever vehicular monitor 80 displays the ID of a "missing" transponder, attending personnel notify the system to broadcast the ID of the now localized transponder at more frequent intervals. Inasmuch as, whenever the ID is received from the locked-on scanned station, the transponder at task 54*b* advances timer T12 to an elapsed state, thereafter, when test 64 is next encountered, receiver 12 will be set temporarily to the base frequency BF. Thus, this more frequent ID broadcasting, which in turn will temporarily transfer receiver 12 to the base frequency BF, will shorten the time required for a "recovering" base 20 to establish communication with a now localized transponder.

The logic performed by microprocessor 21 may be modified to enable base station 20 to monitor several transponders. The ID of each of the transponders to be monitored, after being entered using code selecting means 21*a*, will be shown on numeric display 21*b*. Each transponder 10 will be monitored individually and in sequence during each cycle performed by base 20, while preserving the time T22 between base transmissions to the individual transponder. The IDs of any of the transponders being monitored which are determined by the base to be in a distress situation will also be indicated on display 21*b* and manual means provided to enable the base to concentrate its functions on a single transponder.

Antennas 22*a* of base receivers 22 may be of a directional type to facilitate homing and monitors 80, herein disclosed as simplified receivers for low cost purposes, may also include the various capabilities of bases 20 in a more complex version. Also, antennas 12*a* and 13*a* of transponder 10 and antennas 22*a* and 23*a* of base 20 may be respectively combined into single antennas for both receiving and transmitting functions.

All base stations 20 belonging to the system will broadcast on the same base frequency BF and all transponders likewise will transmit their responses on the same frequency. Whereas both these frequencies may also be the same, it is preferred that base frequency BF be different from the responding transponder frequency for achieving more dependable results by reducing interference.

Rather than just connecting meter 22*b* of base station 20 directly to receiver 22, as shown in FIG. 3, it may be expedient to have meter 22*b* also connected to microprocessor 21 and thereby limit its readings to those incoming signals which have been determined as having the ID of transponder 10 being monitored and sought by the homing procedure.

Whereas, hereinbefore described embodiment comprising transponders 10, bases 20, the station network and vehicular monitors 80 is readily adaptable for monitoring and finding a wide variety of objects, the scope of the invention contemplates modifications being made to suit specific needs of the particular object.

The method embodying the invention locates an object nationwide after losing contact with a local monitor by utilizing the transponder and base station involved in the local monitoring and a network of radio stations and vehicles of local public safety departments. The transponder is attached to the object being monitored locally and responds to radio signals encoded in a predetermined format which includes an ID specific to that transponder. The monitoring base station normally transmits each signal having the ID in a continuous repetitive sequence spaced by a first predetermined time interval. Each station in the network broadcasts a coded list of IDs of transponders reported missing, the encoding being recognizable by the transponder to identify the station as a member of the network, the list being broadcast continuously in repetitive sequence. Each vehicle has a monitor permenantly tuned to the frequency on which the transponder broadcasts and will respond to any signal having a "missing" code by displaying the ID of the transponder transmitting such code. The method comprises the steps of setting the receiver of the transponder to a first frequency for communicating with its base station in local monitoring, timing the intervals between the reception of the signals and changing to a scanning mode when an interval exceeds a second predetermined time interval which is substantially greater than said first time interval. The scanning mode provides for sequentially scanning the frequencies of the broadcast band of the network stations until a member station is found. This member station frequency is locked onto while awaiting reception of the transponder's ID. When this occurs, the transponder will encode its response after first checking the frequency to which the receiver is tuned. If found not to be the base frequency, a response is transmitted which includes a "missing" code. Any vehicular monitor receiving the "missing" code displays the ID and sounds an alarm to alert the personnel who take appropriate steps to find the transponder by homing technique which involves contacting the transponder on the base frequency. The transponder periodically returns to the base frequency to enable this contact to be made. Also, provision is made to periodically interrupt the scanning while searching to find a network station for temporary return to the base frequency.

To more easily send a "forced" code alarm to base 20, transponder 10 may be provided with voice code detector 17 which functions in a well known manner. A word, catchy phrase or expression not normally used in everyday speech is taught to the person to be monitored. His speech pattern, which is to serve as a reference, is initially recorded in voice comparator 17*b* by his reciting the expression into audio transducer 17*a* while depressing button 17*c*. Thereafter, whenever transducer 17*a* picks up a comparable speech pattern, as when the same expression is repeated by the person being monitored when he desires to send a message for help, the "forced" code sensor is activated, test 51 is "yes" and the "forced" code set for immediate transmission by transponder 10. The same result is accomplished when panic button 14 is pressed, but the button may not be readily accessible.

The monitoring and locating system and method herein disclosed is seen to achieve the several objects of the invention and to be well adapted to meet conditions of practical use. As various possible embodiments might be made of this invention, and as various changes might be made in the disclosed system and method, it is to be understood that all matters herein set forth or shown in the accompanying drawings are to be interpreted as illustrative and not in a limiting sense.

What is claimed is:

1. A monitoring and finding system comprising a monitoring base station and a transponder, said base station having a transceiver and alarm condition alerting means, said transceiver having means for intermittently transmitting encoded signals having at least an ID code, said transponder being secured to an object to be monitored and having means for receiving said signals, recognizing said ID code and transmitting an encoded timely response including said ID code, said transceiver having means for detecting the absence of said timely transponder response and activating said alerting means, said transceiver and transponder both having means for selectively transmitting at a normal power or at a relatively higher power, said transceiver having means for transferring the next signal in said intermittent transmission from the normal power to said higher power in the absence of said timely transponder response and for encoding instructions in said next signal for the transponder to likewise transfer to said higher transmitting power, said transceiver having means, responsive to each receipt of said timely transponder response, for setting the transmission of the next signal to said normal power and for encoding instructions to the transponder to transfer to normal power, said high power transmission enabling communication between base and transponder in an out-of-range condition, said base having manual means for de-activating said alerting means, whereby after such manual de-activation, subsequent re-activation of said alerting means indicates a probable out-of-range condition.

2. A monitoring and finding system comprising a monitoring base station and a transponder, said base station having a transceiver and alarm condition alerting means, said transceiver having means for intermittently transmitting encoded signals having at least an ID code, said transponder being secured to an object to be monitored and having means for receiving said signals, recognizing said ID code and transmitting an encoded timely response including said ID code, said transceiver having means for detecting the absence of said timely transponder response and activating said alerting means, in which said base includes a visual signal operating for a predetermined time responsive to each receipt of said timely responder response.

3. A monitoring and finding system comprising a monitoring base station and a transponder, said base station having a transceiver and alarm condition alerting means, said transceiver having means for intermittently transmitting encoded signals having at least an ID code, said transponder being secured to an object to be monitored and having means for receiving said signals, recognizing said ID code and transmitting an encoded timely response including said ID code, said transceiver having means for detecting the absence of said timely transponder response and activating said alerting means, in which said transponder has means for initiating transmission of forced code signals independent of said timely responses and said transceiver has means for activating said alerting means upon receipt of said forced code signals.

4. The system defined in claim 3 in which said transponder has a sensor detecting removal thereof from said object, said forced code transmission initiating means being activated by said sensor detection whereby the transponder repeatedly transmits said forced code signals and said transceiver repeatedly activates said alerting means upon receipt of said forced code signals.

5. The system defined in claim 3 in which said object to be monitored is a person, said forced code transmission initiating means being capable of activation by said person for reporting an emergency to said base whereby the transponder repeatedly transmits said forced code signals and said transceiver repeatedly activates said alerting means upon receipt of said forced code signals.

6. The system defined in claim 5 in which said transponder has an audio transducer and a voice comparator provided with a reference voice pattern of said person being monitored, said activation of the forced code transmission being a recitation of said voice pattern by said person.

7. A monitoring and finding system comprising a monitoring base station and a transponder, said base station having a transceiver and alarm condition alerting means, said transceiver having means for intermittently transmitting encoded signals having at least an ID code, said transponder being secured to an object to be monitored and having means for receiving said signals, recognizing said ID code and transmitting an encoded timely response including said ID code, said transceiver having means for detecting the absence of said timely transponder response and activating said alerting means, in which said transponder has means for selectively transmitting said encoded timely responses in a normal-on-time or in a long-on-time signal, said base having manual means enabling encoding in said intermittent signals instructions to said transponder to transmit the responses in said long-on-time to facilitate meter readings by equipment engaged in homing on said transponder.

8. A monitoring and finding system comprising a monitoring base station and a transponder, said base station having a transceiver and alarm condition alerting means, said transceiver having means for intermittently transmitting encoded signals having at least an ID code, said transponder being secured to an object to be monitored and having means for receiving said signals, recognizing said ID code and transmitting an encoded timely response including said ID code, said transceiver having means for detecting the absence of said timely transponder response and activating said alerting means, in which said base includes a meter for indicating signal strength of said transponder responses, said transponder having means for selectively transmitting said encoded timely responses in a normal-on-time or in a long-on-time signal, said base having manual means enabling encoding in said intermittent signals instructions to said transponder to transmit the responses in said long-on-time to facilitate said meter indications and enable use of said base for homing on said transponder.

9. A monitoring and finding system comprising a monitoring base station and a transponder, said base station having a transceiver and alarm condition alerting means, said transceiver having means for intermittently transmitting encoded signals having at least an ID code, said transponder being secured to an object to be monitored and having means for receiving said signals, recognizing said ID code and transmitting an encoded timely response including said ID code, said transceiver having means for detecting the absence of said timely transponder response and activating said alerting means, in which said base has manual means for deleting the time between said intermittent signals, providing substantially continuous transmission by the base and substantially continuous responses from said transponder, facilitating homing on the latter.

10. A monitoring and finding system comprising a monitoring base station and a transponder, said base station having a transceiver and alarm condition alerting means, said transceiver having means for intermittently transmitting encoded signals having at least an ID code, said transponder being secured to an object to be monitored and having means for receiving said signals, recognizing said ID code and transmitting an encoded timely response including said ID code, said transceiver having means for detecting the absence of said timely transponder response and activating said alerting means, in which said transceiver and transponder both have means for selectively transmitting at a normal power or at a relatively higher power, said transceiver having means for transferring the next signal in said intermittent transmission from the normal power to said higher power in the absence of said timely transponder response and for encoding instructions in said next signal for the transponder to likewise transfer to said higher transmitting power, said transponder having means for initiating transmission of forced code signals independent of said timely responses, and said transceiver having means for activating said alerting means upon receipt of said forced code signals, said transponder having means for selectively transmitting said encoded timely responses in a normal-on-time or in a long-on-time signal, said base having manual means enabling encoding in said intermittent signals instructions to said transponder to transmit the responses in said long-on-time to facilitate meter readings by equipment engaged in homing on said transponder.

11. A monitoring and finding system comprising a plurality of monitoring base stations, a transponder associated by ID code with each of said stations and attached to an object being monitored, each base having means for intermittently transmitting encoded signals having an ID code recognized by the associated transponder, each of said transponders having means for receiving said signals, recognizing said associated ID code and transmitting an encoded timely response including said associated ID code, all of said transponders broadcasting said responses on a common transponder transmitting frequency; a network of radio stations, each station broadcasting a code on its frequency identifying the station as a member of said network, said system maintaining a list of IDs of said transponders reported missing, said list of missing IDs being broadcast continually in a repetitive sequence by each of said network stations, each of said transponders having means for scanning the broadcast band of said network, identifying a network station by said station code, and locking onto said identified station for monitoring said list of missing IDs, each transponder having means responsive to receipt of its associated ID code from said locked-on station for encoding a signal including the associated ID code and a "missing" code and transmitting said encoded signal on said common transponder transmitting frequency; and vehicles of local public safety departments, each vehicle having a monitor equipped with a display, an alerting means and receiver constantly tuned to said common transponder transmitting frequency, said monitors having means for showing the associated ID on said display and activating said alerting means when receiving a signal from a transponder sending said "missing" code.

12. The system defined in claim 11 in which all of said bases transmit on a common base frequency, each of said transponders having means for measuring the time lapse from the reception of the last associated base transmission, each transponder having a receiver initially tuned to said common base transmitting frequency, and each transponder having means for transferring from said common base transmitting frequency to said scanning means when said time lapse exceeds a predetermined duration.

13. The system defined in claim 11 in which all of said bases transmit on a common base frequency, each of said transponders having means for measuring the time lapse from said locking-on to said identified station, each transponder having means for returning said receiving means from the frequency of said locked-on station to said common base transmitting frequency when said time lapse exceeds a predetermined duration thereby enabling said transponder to contact a base station broadcasting an associated ID code and participating in a local homing operation as a result of said vehicular monitor alert.

14. The system defined in claim 13 in which said transfer to said common base transmitting frequency is temporary and said receiver returns to said previously locked-on station in the event no base station is contacted.

15. The system defined in claim 11 in which all of said bases transmit on a common base frequency, said scanning means of each transponder having means for counting each station being scanned and having means for temporarily returning the receiver of each transponder to said common base transmitting frequency after a predetermined count.

16. A method of locating an object attached to a transponder belonging to a nationwide system comprising a plurality of base stations, each monitoring a transponder associated therewith by an ID code, said bases all transmitting and said transponders all receiving on a predetermined common base transmitting frequency, a network of radio stations and vehicles of local public safety departments all affiliated with said system comprising the steps of: reporting the ID of any transponder losing contact with its associated base as "missing"; compiling a list of associated ID codes of "missing" transponders; transmitting said list to each affiliated station in said network for continuous repetitive broadcasting on the respective frequency of each of said stations; transferring the receiver of a transponder, deemed to be "missing" after a predetermined time elapses from the last contact by the transponder with its base, from said common base transmitting frequency to a scanning mode; scanning a broadcast band of predetermined frequencies and testing each for network affiliation; locking onto a scanned frequency found to be a network affiliate and monitoring said affiliate frequency for the ID of the "missing" transponder doing the monitoring; responding to the reception of said ID by transmitting a "missing" code with said ID to be received and processed by a vehicular monitor of one of said local public safety departments.

17. The method defined in claim 16 in which said processing by said vehicular monitor receiving said ID and "missing" codes includes the steps of displaying said ID and activating an alert alarm, and initiating homing procedures to locate said transponder now known to be in the area.

18. The method defined in claim 16 including the step performed by the transponder of: returning periodically and temporarily from said locked-on station frequency to said common base transmitting frequency for communicating with a base, enabling the performance of a homing procedure.

19. The method defined in claim 18 including the step performed by the transponder of: changing the temporary status of said return to the common base transmitting frequency to a permanent status after receiving a signal from a base while in said temporary status.

20. The method defined in claim 16 including the steps performed by the transponder of: counting the number of stations scanned and returning temporarily from said scanning mode to said common base transmitting frequency after a predetermined number of stations have been scanned.

21. A method of monitoring and locating an object attached to a transponder being monitored by a base station having an associated ID code comprising the steps of: intermittently transmitting at a normal power, by the base, an encoded signal including the ID code and instructions to the transponder to respond at a normal power and awaiting a timely response from the transponder; upon failure of the base to receive said timely response from the transponder, activating an alarm at the base and increasing the next transmission by the base to a higher power and including instructions in said encoded signal to the transponder to likewise transmit its response at a higher power; and de-activating the alarm at the base before the elapse of a predetermined time interval whereby repeated alarm activation and de-activation is indicative of a probable out-of-range condition.

* * * * *